US011824283B2

(12) United States Patent
Choi et al.

(10) Patent No.: US 11,824,283 B2
(45) Date of Patent: Nov. 21, 2023

(54) ANTENNA ELEMENT AND DISPLAY DEVICE INCLUDING THE SAME

(71) Applicant: DONGWOO FINE-CHEM CO., LTD., Jeollabuk-do (KR)

(72) Inventors: Byung Jin Choi, Incheon (KR); Young Ju Kim, Gyeonggi-do (KR); Dong Pil Park, Incheon (KR)

(73) Assignee: DONGWOO FINE-CHEM CO., LTD., Jeollabuk-Do (KR)

( * ) Notice: Subject to any disclaimer, the term of this patent is extended or adjusted under 35 U.S.C. 154(b) by 140 days.

(21) Appl. No.: 17/524,924

(22) Filed: Nov. 12, 2021

(65) Prior Publication Data

US 2022/0158350 A1 May 19, 2022

(30) Foreign Application Priority Data

Nov. 13, 2020 (KR) ..... 10-2020-0152042

(51) Int. Cl.
*H01Q 9/04* (2006.01)
*H01Q 1/48* (2006.01)

(52) U.S. Cl.
CPC ..... *H01Q 9/0471* (2013.01); *H01Q 1/48* (2013.01); *H01Q 9/0414* (2013.01)

(58) Field of Classification Search
CPC ..... H01Q 9/0414; H01Q 9/045; H01Q 1/38; H01Q 9/0407
See application file for complete search history.

(56) References Cited

U.S. PATENT DOCUMENTS

2006/0092080 A1* 5/2006 Lee ..... H01Q 9/0471 343/700 MS
2009/0174612 A1* 7/2009 Ayala ..... H01Q 9/42 343/702
2018/0253170 A1* 9/2018 Noh ..... H05K 3/046
2020/0403297 A1* 12/2020 Park ..... H01Q 1/243

FOREIGN PATENT DOCUMENTS

KR 10-2003-0095557 A 12/2003
KR 102031203 B1 * 10/2019 ..... H01Q 9/045

* cited by examiner

*Primary Examiner* — Dimary S Lopez Cruz
*Assistant Examiner* — Aladdin Abdulbaki
(74) *Attorney, Agent, or Firm* — The PL Law Group, PLLC

(57) ABSTRACT

An antenna element according to an embodiment of the present invention includes a radiation body including a contact part which is concave toward the transmission line, a transmission line disposed on a different layer from the radiation body and connected to the radiation body through the contact part, and a signal pad connected to an end of the transmission line.

9 Claims, 4 Drawing Sheets

ANTENNA ELEMENT AND DISPLAY DEVICE INCLUDING THE SAME

CROSS-REFERENCE TO RELATED APPLICATION(S)

This application claims priority to Korean Patent Application No. 10-2020-0152042 filed on Nov. 13, 2020, in the Korean Intellectual Property Office (KIPO), the entire disclosure of which is incorporated by reference herein.

BACKGROUND

1. Field

The present invention relates to an antenna element and a display device including the same, and more particularly, to an antenna element which includes a radiation body and a power supply line, and a display device including the same.

2. Description of the Related Art

Recently, according to development of the information-oriented society, wireless communication techniques such as Wi-Fi, Bluetooth, and the like are implemented, for example, in a form of smartphones by combining with display devices. In this case, an antenna may be coupled to the display device to perform a communication function.

Recently, with mobile communication techniques becoming more advanced, an antenna for performing communication in ultra-high frequency bands has been applied to various target structures such as display devices, vehicles and buildings.

In particular, as the size of the display device is decreased, the antenna may be disposed in a display region of the display device, and in this case, a conductive pattern included in the antenna may be viewed by a user, thereby causing a deterioration in image quality of the display device.

However, when changing a material or structure of the conductive pattern in order to reduce visibility of the conductive pattern included in the antenna, a resistance of the conductive pattern is increased, such that radiation characteristics of the antenna may be decreased.

For example, Korean Patent Laid-Open Publication No. 2003-0095557 discloses an antenna structure embedded in a portable terminal, but does not sufficiently disclose an antenna design in consideration of both the resistance and optical characteristics as described above.

SUMMARY

It is an object of the present invention to provide an antenna element having improved optical and electrical characteristics.

Another object of the present invention is to provide a display device including the antenna element having the improved optical and electrical characteristics.

To achieve the above objects, the following technical solutions are adopted in the present invention.

1. An antenna element including: a radiation body including a contact part which is concave toward the transmission line; a transmission line disposed on a different layer from the radiation body and connected to the radiation body through the contact part; and a signal pad connected to an end of the transmission line.

2. The antenna element according to the above 1, wherein the contact part is formed in a first region close to the signal pad among the first region and a second region of the radiation body divided by a straight line which bisects the radiation body to have the same length as each other.

3. The antenna element according to the above 1, wherein the radiation body is formed to have substantially the same thickness over the entire region thereof.

4. The antenna element according to the above 1, wherein the contact part is provided as a single member integrally connected with the radiation body.

5. The antenna element according to the above 1, wherein the radiation body and the transmission line include a mesh pattern, respectively.

6. The antenna element according to the above 1, further including a first dummy pattern formed adjacent to the transmission line on the same layer as the transmission line, and a second dummy pattern formed adjacent to the radiation body on the same layer as the radiation body.

7. The antenna element according to the above 1, wherein the signal pad includes a solid metal pattern.

8. The antenna element according to the above 1, further including a ground pad disposed around the signal pad with being separated from the transmission line and the signal pad.

9. The antenna element according to the above 8, wherein the ground pad includes a solid metal pattern.

10. A display device including the antenna element of the above 1.

According to embodiments of the present invention, the transmission line and the radiation body may be disposed on different layers from each other. The radiation body may include a contact part, and may be connected to the transmission line through the contact part.

In this case, by adjusting a position of the contact part in the radiation body electrically connected to the transmission line, it is possible to easily control an impedance of the antenna element in a range suitable for a specific frequency (e.g., 3G, 4G, 5G or higher). Accordingly, transmission/reception characteristics of the antenna in a high frequency region may be improved.

In some embodiments, the radiation body and the transmission line may include a mesh pattern to improve optical characteristics of the antenna element.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

Figure 1:
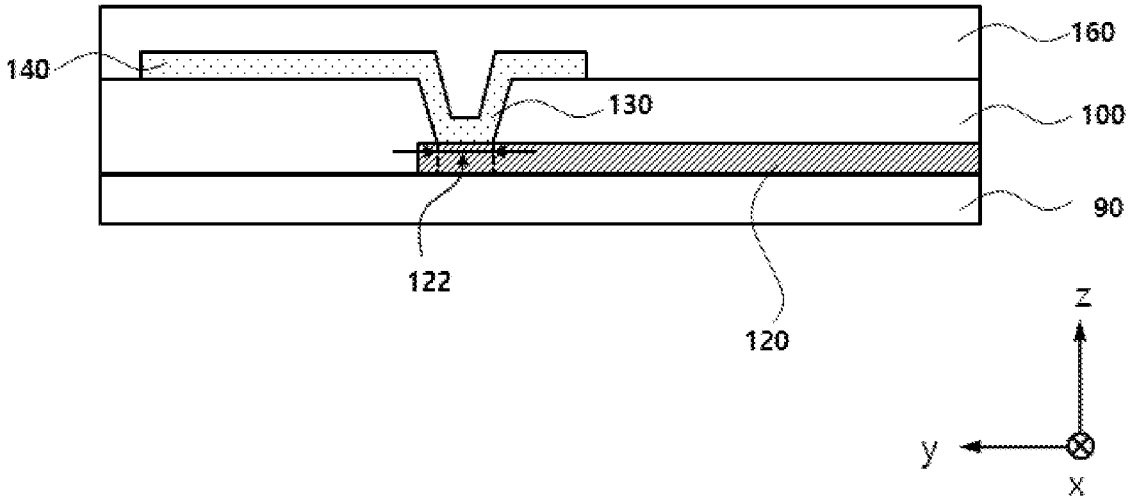
FIG. 1 is a schematic cross-sectional view of an antenna element according to exemplary embodiments.

Hereinafter, embodiments will be described in detail with reference to the accompanying drawings. In denoting reference numerals to components of respective drawings, it should be noted that the same components will be denoted by the same reference numerals although they are illustrated in different drawings.

In description of preferred embodiments of the present invention, the publicly known functions and configurations that are judged to be able to make the purport of the present invention unnecessarily obscure will not be described in detail. Further, wordings to be described below are defined in consideration of the functions of the embodiments, and may differ depending on the intentions of a user or an operator or custom. Accordingly, such wordings should be defined on the basis of the contents of the overall specification.

It will be understood that, although the terms first, second, etc. may be used herein to describe various elements or components, these elements or components should not be limited by these terms. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, components and/or a combination thereof, but do not preclude the presence or addition of one or more other features, integers, steps, operations, elements, components, and/or a combination thereof.

Further, directional terms such as "one side," "the other side," "upper," "lower," and the like are used in connection with the orientation of the disclosed drawings. Since the elements or components of the embodiments of the present invention may be located in various orientations, the directional terms are used for illustrative purposes, and are not intended to limit the present invention thereto.

In addition, a division of the configuration units in the present disclosure is intended for ease of description and divided only by the main function set for each configuration unit. That is, two or more of the configuration units to be described hereinafter may be combined into a single configuration unit or formed by two or more of divisions by function into more than a single configuration unit. Further, each of the configuration units to be described hereinafter may additionally perform a part or all of the functions among functions set for other configuration units other than being responsible for the main function, and a part of the functions among the main functions set for each of the configuration units may be exclusively taken and certainly performed by other configuration units An antenna element described in the present disclosure may be a patch antenna or a microstrip antenna manufactured in a form of a transparent film. For example, the antenna element may be applied to electronic devices for high frequency or ultra-high frequency (e.g., 3G, 4G, 5G or more) mobile communication, Wi-Fi, Bluetooth, near field communication (NFC), global positioning system (GPS), and the like, but it is not limited thereto. Herein, the electronic device may include a mobile phone, a smart phone, a tablet, a laptop computer, a personal digital assistant (PDA), a portable multimedia player (PMP), a navigation device, an MP3 player, a digital camera, a wearable device and the like. The wearable device may include a wristwatch type, a wrist band type, a ring type, a belt type, a necklace type, an ankle band type, a thigh band type, a forearm band type wearable device or the like. However, the electronic device is not limited to the above-described example, and the wearable device is also not limited to the above-described example. In addition, the antenna element may be applied to various objects or structures such as vehicles and buildings.

In the following drawings, two directions which are parallel to an upper surface of a dielectric layer and intersect each other perpendicularly are defined as an x direction and a y direction, and a direction perpendicular to the upper surface of the dielectric layer is defined as a z direction. For example, the x direction may correspond to a width direction of the antenna element, the y direction may correspond to a length direction of the antenna element, and the z direction may correspond to a thickness direction of the antenna element.

Figure 2:
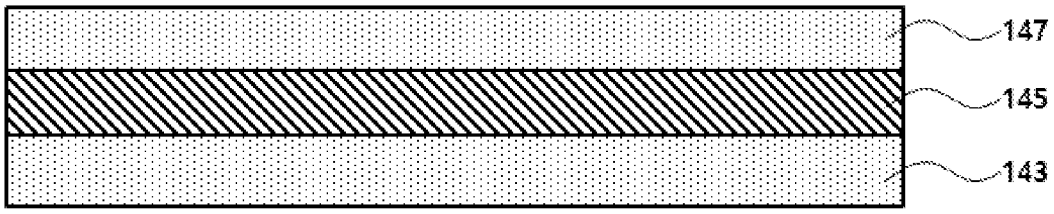
FIG. 2 is a schematic cross-sectional view of an antenna conductive layer according to exemplary embodiments.

FIG. 1 is a schematic cross-sectional view of an antenna element according to exemplary embodiments, and FIG. 2 is a schematic cross-sectional view of an antenna conductive layer according to exemplary embodiments.

Referring to FIG. 1, the antenna element may include a first antenna conductive layer 120, a second antenna conductive layer 140, a lower insulation layer 90 and an interlayer insulation layer 100.

The lower insulation layer 90 may be provided as a substrate layer or a base layer for forming the first antenna conductive layer 120, for example. The interlayer insulation layer 100 may be provided as an intermediate layer for separating the first antenna conductive layer 120 and the second antenna conductive layer 140 from each other.

The lower insulation layer 90 and/or the interlayer insulation layer 100 may be provided as a dielectric layer of the antenna element. For example, the lower insulation layer 90 and/or the interlayer insulation layer 100 may include a polyester resin such as polyethylene terephthalate, polyethylene isophthalate, polyethylene naphthalate, polybutylene terephthalate, etc.; a cellulose resin such as diacetyl cellulose, triacetyl cellulose, etc.; a polycarbonate resin; an acrylic resin such as polymethyl (meth)acrylate, polyethyl (meth)acrylate, etc.; a styrene resin such as polystyrene, acrylonitrile-styrene copolymer, etc.; a polyolefin resin such as polyethylene, polypropylene, cyclic polyolefin or polyolefin having a norbornene structure, ethylene-propylene copolymer, etc.; a vinyl chloride resin; an amide resin such as nylon, aromatic polyamide; an imide resin; a polyether sulfonic resin; a sulfonic resin; a polyether ether ketone resin; a polyphenylene sulfide resin; a vinylalcohol resin; a vinylidene chloride resin; a vinylbutyral resin; an allylate resin; a polyoxymethylene resin; a thermoplastic resin such as an epoxy resin and the like. These compounds may be used alone or in combination of two or more thereof.

In addition, a transparent film made of a thermosetting resin or an ultraviolet curable resin such as (meth)acrylate, urethane, acrylic urethane, epoxy, silicone, and the like may be used as the lower insulation layer 90 and/or the interlayer insulation layer 100. In some embodiments, an adhesive film such as an optically clear adhesive (OCA), an optically clear resin (OCR), and the like may also be included in the lower insulation layer 90 and/or the interlayer insulation layer 100.

For example, the lower insulation layer 90 and/or the interlayer insulation layer 100 may include an inorganic insulation material such as glass, silicon oxide, silicon nitride, silicon oxynitride or the like.

For example, the lower insulation layer 90 and/or the interlayer insulation layer 100 may be provided as substantially a single layer. In one embodiment, the lower insulation layer 90 and/or the interlayer insulation layer 100 may also include a multilayer structure of two or more layers.

Capacitance or inductance may be generated by the lower insulation layer 90 and/or the interlayer insulation layer 100, thus to adjust a frequency band which can be driven or sensed by the antenna element.

In some embodiments, the dielectric constant of the lower insulation layer 90 and/or the interlayer insulation layer 100 may be adjusted in a range of about 1.5 to 12, and preferably about 2 to 12. When the dielectric constant exceeds about 12, a driving frequency is excessively reduced, such that driving of the antenna in a desired high frequency band may not be implemented.

In some embodiments, an insulation layer (e.g., an encapsulation layer, a passivation layer, etc. of a display panel) inside the display device on which the antenna element is mounted may be provided as the lower insulation layer 90.

The first antenna conductive layer 120 may be formed on the lower insulation layer 90. The first antenna conductive layer 120 may include a low resistance metal such as silver (Ag), gold (Au), copper (Cu), aluminum (Al), platinum (Pt), palladium (Pd), chromium (Cr), titanium (Ti), tungsten (W), niobium (Nb), tantalum (Ta), vanadium (V), iron (Fe), manganese (Mn), cobalt (Co), nickel (Ni), zinc (Zn), tin (Sn), molybdenum (Mo), calcium (Ca), or an alloy including at least one thereof. These may be used alone or in combination of two or more thereof. For example, the first antenna conductive layer 120 may include silver (Ag) or a silver alloy (e.g., a silver-palladium-copper (APC) alloy) to implement a low resistance.

In an embodiment, the first antenna conductive layer 120 may include copper (Cu) or a copper alloy (e.g., a copper-calcium (CuCa) alloy) in consideration of low resistance and fine line width patterning.

In some embodiments, as will be described below with reference to FIG. 3, the first antenna conductive layer 120 may include a transmission line 110 and a signal pad 112 of the antenna element.

The interlayer insulation layer 100 may be formed on the lower insulation layer 90 to cover the first antenna conductive layer 120.

A second antenna conductive layer 140 may be formed on the interlayer insulation layer 100. In some embodiments, as will be described below with reference to FIG. 3, the second antenna conductive layer 140 may include a radiation body 150.

In exemplary embodiments, each of the first antenna conductive layer 120 and/or the second antenna conductive layer 140 may have a single layer structure formed of the above-described metal or alloy.

According to exemplary embodiments, each of the first antenna conductive layer 120 and/or the second antenna conductive layer 140 may include a lamination structure of a transparent conductive oxide layer and metal layer, for example, may have a two-layer structure of transparent conductive oxide layer-metal layer or a three-layer structure of transparent conductive oxide layer-metal layer-transparent conductive oxide.

According to an exemplary embodiment, the first antenna conductive layer 120 and/or the second antenna conductive layer 140 may be subjected to blackening treatment. For example, the surface of the first antenna conductive layer 120 and/or the second antenna conductive layer 140 may be subjected to thermal oxidization, thereby reducing reflectance. Accordingly, it is possible to reduce the pattern (antenna) from being viewed due to light reflection on the surface of the first antenna conductive layer 120 and/or the second antenna conductive layer 140.

A surface portion of a metal layer of the first antenna conductive layer 120 and/or the second antenna conductive layer 140 may be subjected to blackening treatment to form a blackened layer in which a portion of the metal layer is made of metal oxide or metal sulfide. Further, a blackened layer such as a coating film of a black material, or a plating layer of metal such as nickel and chromium may be formed on the metal layer.

The blackened layer is intended to improve transparency and visibility of the metal layer by reducing the reflectance of the metal layer, and may include, for example, at least one of silicon oxide, metal oxide, copper, molybdenum, carbon, tin, chromium, nickel and cobalt.

The composition and thickness of the blackened layer may be variously adjusted according to a desired degree of blackening.

According to an exemplary embodiment, as shown in FIG. 2, the first antenna conductive layer 120 and/or the second antenna conductive layer 140 may include a first transparent conductive oxide layer 143, a metal layer 145, and a second transparent conductive oxide layer 147, which are sequentially stacked one above the other. In this case, it is possible to improve the transmittance of the first antenna conductive layer 120 and/or the second antenna conductive layer 140, thereby preventing the pattern (antenna) from being viewed and reduce a degradation of image quality in a visual region VA.

In addition, the resistance may be reduced to improve signal transmission speed, while improving flexible properties of the first antenna conductive layer 120 and the second antenna conductive layer 140 by the metal layer 145. Further, as the metal layer 145 is sandwiched between the transparent conductive oxide layers 143 and 147, corrosion resistance and transparency of the first antenna conductive layer 120 and the second antenna conductive layer 140 may be improved.

For example, the transparent conductive oxide layer of the first antenna conductive layer 120 and/or the second antenna conductive layer 140 may include a transparent conductive oxide such as indium tin oxide (ITO), indium zinc oxide (IZO), zinc oxide (ZnOx), indium zinc tin oxide (IZTO), tin oxide (SnOx), cadmium tin oxide (CTO) and the like.

In some embodiments, the first antenna conductive layer 120 may include a transmission line 110 including a contact region 122, and the second antenna conductive layer 140 may include the radiation body 150 electrically connected to the contact region 122 of the transmission line 110. On the other hand, the second antenna conductive layer 140 may include the transmission line 110 including the contact region 122, and the first antenna conductive layer 120 may include the radiation body 150 electrically connected to the contact region 122 of the transmission line 110.

For example, the radiation body 150 may be formed on the interlayer insulation layer 100 to be disposed at an upper layer level of the transmission line 110.

According to exemplary embodiments, the radiation body 150 may include a contact part 130 connected to the contact region 122 of the transmission line 110. For example, the contact part 130 may be a portion of the radiation body 150, which is concave toward the contact region 122 of the transmission line 110.

For example, a taper-shaped contact hole for partially exposing an upper surface of the first antenna conductive layer 120 may be formed in the interlayer insulation layer 100, and a conductive layer-forming slurry for forming the second antenna conductive layer 140 may be applied to an upper surface of the interlayer insulation layer 100, followed by drying the same to form a conductive layer. A portion of the conductive layer may be formed to cover a wall surface of the contact hole and the partially exposed upper surface of the first antenna conductive layer 120 to have substantially the same thickness as the other portions thereof. As a result, the contact part 130 concave toward the contact region 122 of the transmission line 110 may be formed in the conductive layer. In this case, the conductive layer may be formed to have substantially the same thickness over the entire region thereof.

For example, the contact part 130 may be provided as a single member substantially integrally connected with the second antenna conductive layer 140. For example, the contact part 130 may be provided as a single member substantially integrally connected with the radiation body 150.

When providing the contact part 130 as a single member by substantially integrally connecting it with the second antenna conductive layer 140, electrical signal loss which may occur at a bonding portion between the contact part 130 and the second antenna conductive layer 140 is reduced, such that transmission/reception efficiency of the antenna element can be further improved.

In some embodiments, a passivation layer 160 for covering the second antenna conductive layer 140 may be formed on the interlayer insulation layer 100. The passivation layer 160 may include, for example, an inorganic insulation material such as silicon oxide, silicon oxynitride, silicon nitride, glass, or the like, an organic insulation material such as an acrylic resin or siloxane resin, or an organic/inorganic composite insulation film.

Figure 3:
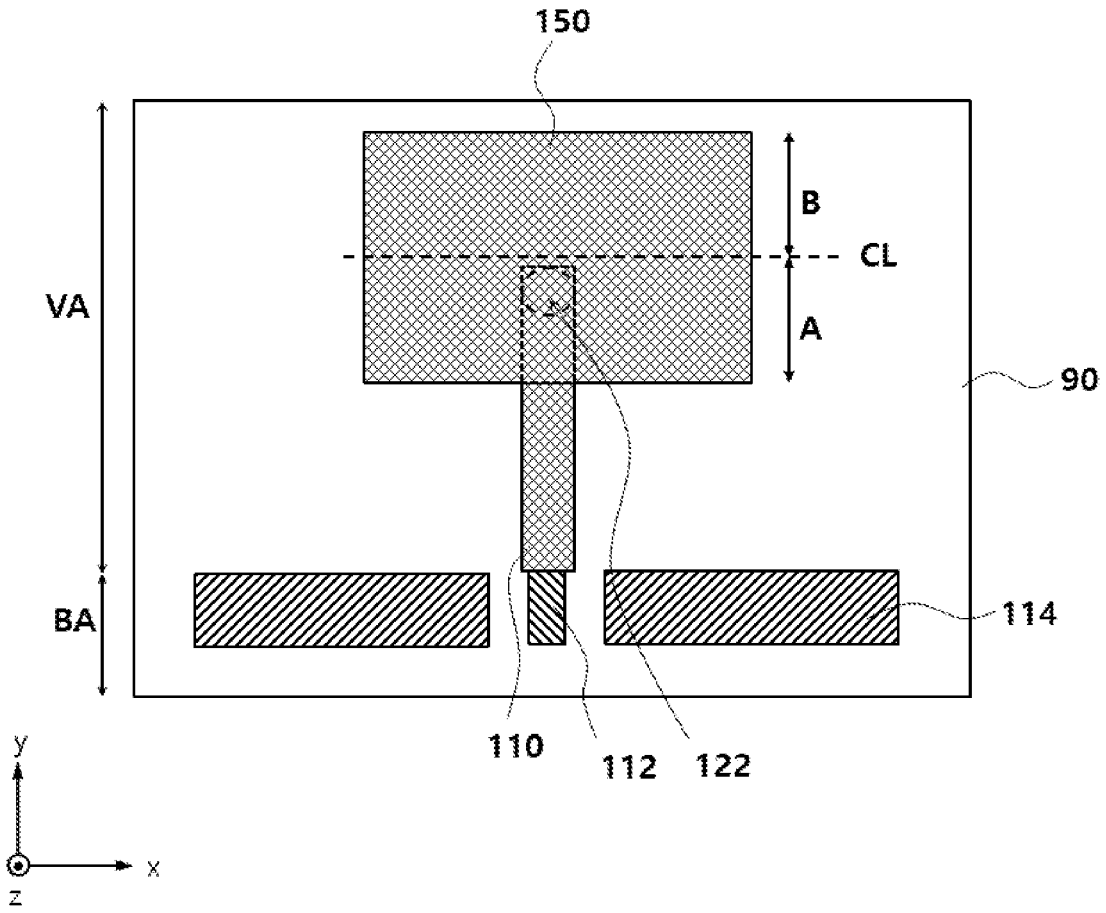
FIG. 3 is a schematic plan view of an antenna element according to exemplary embodiments.

FIG. 3 is a schematic plan view of an antenna element according to exemplary embodiments. For the convenience of description, the interlayer insulation layer 100 and the contact part 130 are not illustrated in FIG. 3.

Referring to FIGS. 1 and 3, as described above, the second antenna conductive layer 140 may include the radiation body 150, and the first antenna conductive layer 120 may include the transmission line 110. In this case, the transmission line 110 may include the contact region 122, and the radiation body 150 may be connected with the contact region 122 of the transmission line 110. For example, the radiation body 150 may include the contact part 130 which is a portion of the radiation body 150 concave toward the contact region 122 of the transmission line 110, and the radiation body 150 may be connected to the contact region 122 of the transmission line 110 through the contact part 130.

The contact region 122 is illustrated in a circular shape in FIG. 3, but the shape of the contact region 122 may be appropriately changed in consideration of an etching process, such as a rectangular, hexagonal, octagonal shape or the like.

The transmission line 110 may be disposed on a different layer from the radiation body 150 and may extend in a longitudinal direction (e.g., a y-direction) of the antenna element. The radiation body 150 may be divided into a first region A and a second region B by a straight line CL which bisects the radiation body 150 to have the same length. The contact part 130 of the radiation body 150 may be formed in the first region A close to the signal pad 112 of the first and second regions A and B.

The radiation body 150 may be electrically connected with the contact region 122 of the transmission line 110 through the contact part 130 formed in the first region A of the first and second regions A and B of the divided radiation body 150. According to an exemplary embodiment, by adjusting a position where the contact part 130 is formed, the impedance of the antenna element may be easily controlled in a range suitable for a specific frequency.

For example, the impedance of the antenna element may be more easily controlled in a range of 45Ω to 55Ω suitable for a high frequency (e.g., 28 GHz). Accordingly, the transmission/reception efficiency of the antenna element may be further increased.

According to an exemplary embodiment, the contact part 130 may be formed to be spaced apart from each side of the radiation body 150, but it is not limited thereto.

According to exemplary embodiments, the radiation body 150 and the transmission line 110 may include a mesh pattern, respectively. For example, the mesh pattern may include electrode lines intersecting each other therein. In this case, the reflectance of the radiation body 150 and the transmission line 110 may be reduced by the mesh pattern. Accordingly, optical characteristics of the antenna element may be improved.

As shown in FIG. 3, an upper surface of the lower insulation layer 90 or the antenna element may be divided into the visual region VA and a bonding region BA. For example, the visual region VA may be included in a display region of the display device on which the antenna element is mounted.

Coupling or connection of the antenna element and an antenna driving integrated circuit (IC) chip may be performed in the bonding region BA. For example, the bonding region BA may be included in a peripheral region or a bezel region of the display device.

According to the embodiment shown in FIG. 3, the radiation body 150 and the transmission line 110 may be disposed in the visual region VA. Thereby, the radiation body 150 and the transmission line 110 may be formed to include the mesh pattern, thus to improve transmittance in the visual region VA.

For example, the first antenna conductive layer 120 including the transmission line 110 may further include a first dummy pattern (not illustrated), and the second antenna conductive layer 140 including the radiation body 150 may further include a second dummy pattern (not illustrated).

For example, the first dummy pattern may be formed adjacent to the transmission line 110 on the same layer as the transmission line 110, and the second dummy pattern may be formed adjacent to the radiation body 150 on the same layer as the radiation body 150. In this case, by the first dummy pattern and the second dummy pattern, it is possible to prevent the pattern (antenna) from being viewed and reduce a degradation of image quality in the visual region VA.

The signal pad 112 may be connected to an end of the transmission line 110. The signal pad 112 may be disposed in the bonding region BA to be provided as a connection pad with the above-described antenna driving IC chip.

For example, the signal pad 112 and the antenna driving IC chip may be connected to each other through a circuit relay structure such as a flexible printed circuit board (FPCB) or an anisotropic conductive film (ACF).

The antenna driving integrated circuit (IC) chip may also be disposed on a flexible circuit board (FPCB) or on another circuit board connected to the flexible circuit board. For example, the flexible circuit board (FPCB) may further include a circuit or a contact for electrically connecting the antenna driving integrated circuit (IC) chip and a power supply line. By disposing the flexible circuit board (FPCB) and the antenna driving integrated circuit (IC) chip adjacent to each other, signal loss may be suppressed by shortening a path for transmitting and receiving signals The signal pad 112 may be formed in a solid pattern to reduce a power supply resistance. In one embodiment, the signal pad 112 may be provided as a single member substantially integrally connected with the end of the transmission line 110.

In some embodiments, the first antenna conductive layer 120 may further include a ground pad 114 disposed around the signal pad 112. For example, as shown in FIG. 3, a pair of ground pads 114 may face each other while being electrically and physically separated from the transmission line 110 and/or the signal pad 112 with the signal pad 112 interposed therebetween.

In some embodiments, the ground pad 114 may include a solid pattern structure or a mesh pattern. For example, the ground pad 114 may be disposed in the bonding region BA together with the signal pad 112.

The transmission line 110 may be formed to include only a metal layer (e.g., a metal mesh layer or a solid metal pattern layer), thus to reduce the power supply resistance. The signal pad 112 and the ground pad 114 may also include only the metal layer.

Lengths or areas of the transmission line 110 and the signal pad 112 may be adjusted depending on the lengths or areas of the visual region VA and the bonding region BA.

Figure 4:
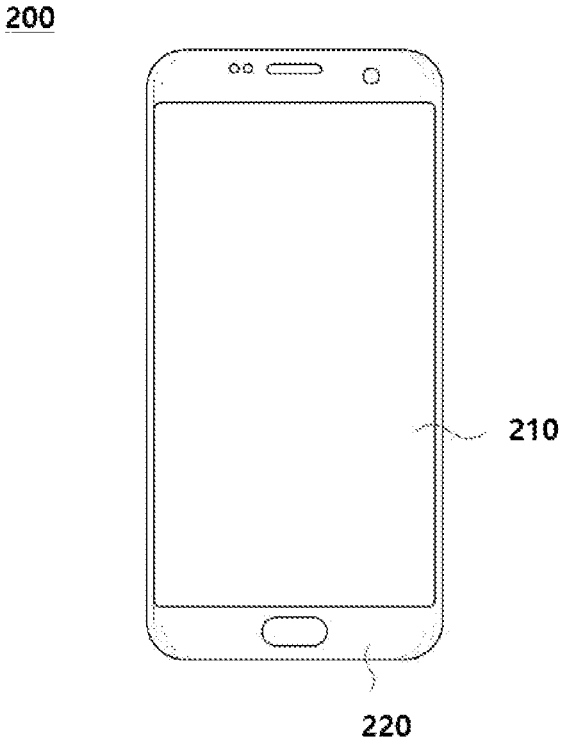
FIG. 4 is a schematic plan view for describing a display device according to exemplary embodiments.

FIG. 4 is a schematic plan view for describing a display device according to exemplary embodiments. For example, FIG. 4 shows an external shape including a window of the display device.

Referring to FIG. 4, a display device 200 may include a display region 210 and a peripheral region 220. The peripheral region 220 may be disposed, for example, on both sides and/or both ends of display region 210. The peripheral region 220 may correspond to, for example, a light-shielding part or a bezel part of the image display device.

The above-described antenna element may be disposed over the display region 210 and the peripheral region 220 of the display device 200. For example, the visual region VA of the antenna element shown in FIG. 3 may be included in the display region 210, and the bonding region BA of the antenna element may be included in the peripheral region 220.

In this case, the radiation body 150 may be arranged in the display region 210. As described above, it is possible to prevent the radiation bodies 150 from being viewed by the user by using the mesh pattern. In addition, by increasing the transparency of the radiation body 150 through the transparent conductive oxide layer, it is possible to prevent the deterioration of image quality in the display region 210.

For example, the transmission line 110 may also include a mesh pattern, and the signal pad 112 may be connected to the antenna driving IC chip in the peripheral region 220. Signal pad 112 may include a solid metal pattern to reduce the bonding resistance and power supply resistance.

Through a combination of the above-described structure and material of the antenna element, driving of antenna may be implemented with improved electrical and optical characteristics in the display device 200 together.

In addition, with mobile communication techniques becoming more advanced in recent years, an antenna for performing communication in ultra-high frequency bands has been applied to various target structures such as display devices, vehicles and buildings.

Hereinafter, experimental examples including specific examples and comparative examples will be described to more concretely understand the present invention. However, those skilled in the art will appreciate that such examples are provided for illustrative purposes and do not limit subject matters to be protected as disclosed in appended claims. Therefore, it will be apparent to those skilled in the art various alterations and modifications of the embodiments are possible within the scope and spirit of the present invention and duly included within the range as defined by the appended claims.

Example 1

A lower insulation layer was prepared. After a transmission line was formed on the lower insulation layer, an interlayer insulation layer for covering the transmission line was formed thereon. A contact hole was formed in the interlayer insulation layer so as to expose a contact region of the transmission line. Then, a radiation body having substantially the same thickness including a contact part was formed while covering a wall surface of the contact hole and the contact region with a conductive material.

Figure 5:
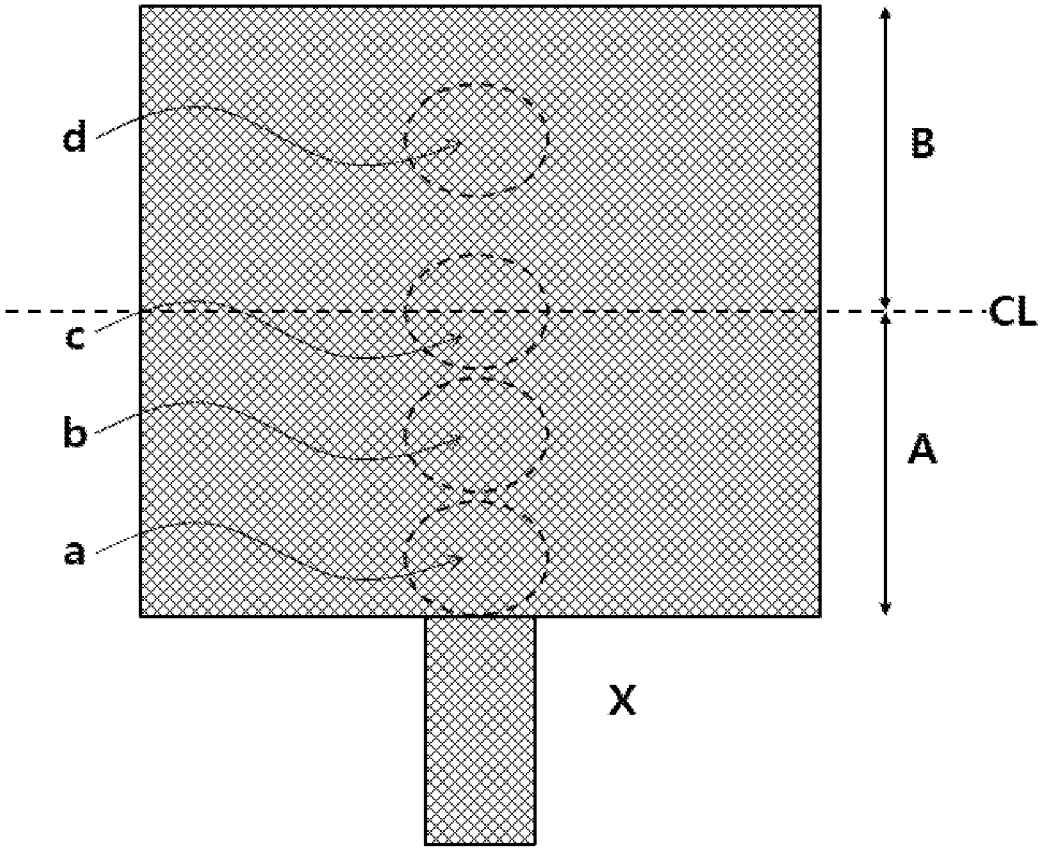
FIG. 5 is a schematic plan view illustrating a position of a contact region formed in the antenna element according to exemplary embodiments and comparative examples.

In this case, referring to FIG. 5, the contact part was formed in a region b of FIG. 5. Thereafter, a passivation layer was formed on the radiation body to manufacture an antenna element.

Example 2 and Comparative Examples 1 and 2

Antenna elements were manufactured according to the same procedures as described in Example 1, except that a position of a region in the radiation body where the contact part is formed was adjusted as shown in Table 1 below by referring to FIG. 5.

Comparative Example 3

A lower insulation layer was prepared. A transmission line and a radiation body were formed on the lower insulation layer in the same layer. An antenna element was manufactured by forming an upper insulation layer on the transmission line and the radiation body.

Experimental Example (1) Measurement of Impedance

Impedances of all the antenna elements according to the examples and the comparative examples were measured using a vector network analyzer (VNA, Anritsu Com.), and results thereof are shown in Table 1 below.

(2) Measurement of Reflection Coefficient (S11)

Reflection coefficients (S11) of the antenna elements according to the examples and the comparative examples were measured using the vector network analyzer (VNA, Anritsu Com.), and results thereof are shown in Table 1 below.

(3) Measurement of Realized Gain

Realized gains of the antenna elements according to the examples and the comparative examples were measured using the vector network analyzer (VNA, Anritsu Com.) and a radiation chamber (CNG Com.), and results thereof are shown in Table 1 below.

TABLE 1

| | Position where contact part is formed | Impedance (Ω) | S11 (dB) | Realized gain |
|---|---|---|---|---|
| Example 1 | b | 52.9 | −15.62 | 3.846 |
| Example 2 | a | 55.0 | −12.31 | 3.366 |
| Comparative Example 1 | c | 60.1 | −2.89 | 1.77 |

TABLE 1-continued

| | Position where contact part is formed | Impedance (Ω) | S11 (dB) | Realized gain |
|---|---|---|---|---|
| Comparative Example 2 | d | 82.5 | −1.59 | 0.109 |
| Comparative Example 3 | — | 35.8 | −8.8 | 2.393 |

Referring to Table 1 above, the antenna elements according to the examples in which the contact part was formed in the first region A might have an impedance value (e.g., 50Ω) suitable for a high frequency (e.g., 28 GHz). Accordingly, the transmission/reception efficiency of the antenna element was improved.

However, the antenna elements according to Comparative Examples 1 and 2 in which at least a portion of the contact part was deviated from the first region A, and Comparative Example 3 in which the transmission line and the radiation body were formed on the same layer, the impedance value was out of the appropriate impedance value range, and thereby the transmission/reception efficiency of the antenna element was reduced.

What is claimed is:

1. An antenna element comprising:

a radiation body comprising a contact part which is concave toward a transmission line;

the transmission line disposed on a different layer from the radiation body and connected to the radiation body through the contact part;

an interlayer insulation layer formed between the radiation body and the transmission line; and a signal pad connected to an end of the transmission line, wherein the transmission line extends in a longitudinal direction of the antenna element, wherein the contact part is composed of a taper-shaped contact hole formed to have a partially exposed surface of the transmission line in the interlayer insulation layer, and a conductive layer applied to a wall surface of the taper-shaped contact hole and the partially exposed surface.

2. The antenna element according to claim 1, wherein the contact part is formed in a first region close to the signal pad among the first region and a second region of the radiation body divided by a straight line which bisects the radiation body to have the same length as each other.

3. The antenna element according to claim 1, wherein the radiation body is formed to have substantially the same thickness over the entire region thereof.

4. The antenna element according to claim 1, wherein the contact part is provided as a single member integrally connected with the radiation body.

5. The antenna element according to claim 1, wherein the radiation body and the transmission line comprise a mesh pattern, respectively.

6. The antenna element according to claim 1, wherein the signal pad comprises a solid metal pattern.

7. The antenna element according to claim 1, further comprising a ground pad disposed around the signal pad with being separated from the transmission line and the signal pad.

8. The antenna element according to claim 7, wherein the ground pad comprises a solid metal pattern.

9. A display device comprising the antenna element of claim 1.

* * * * *